US005963763A

United States Patent [19]

Kabai et al.

[11] Patent Number: 5,963,763

[45] Date of Patent: Oct. 5, 1999

[54] IMAGE FORMING APPARATUS USING A DEVELOPING AGENT HAVING COMPONENTS OF VARYING SIZE

[75] Inventors: Takahito Kabai; Yasuo Goto, both of Yokohama, Japan

[73] Assignee: Kabushiki Kaisha Toshiba, Kawasaki, Japan

[21] Appl. No.: 09/120,731

[22] Filed: Jul. 23, 1998

[30] Foreign Application Priority Data

Jul. 25, 1997 [JP] Japan ..... 9-200075

[51] Int. Cl.[6] ..... G03G 15/01

[52] U.S. Cl. ..... 399/223; 399/298; 430/111

[58] Field of Search ..... 399/223, 298; 430/110, 111

[56] References Cited

U.S. PATENT DOCUMENTS 5,122,843 6/1992 Yokoyama et al. ..... 430/111
5,620,823 4/1997 Kambayashi et al. ..... 430/111
5,774,771 6/1998 Kukimoto et al. ..... 399/223

FOREIGN PATENT DOCUMENTS 6-110343 4/1994 Japan .

*Primary Examiner*—Arthur T. Grimley
*Assistant Examiner*—William A. Noe
*Attorney, Agent, or Firm*—Foley & Lardner

[57] ABSTRACT

Disclosed is a color image forming apparatus in which a plurality of developed images superposed one upon the other are transferred onto a recording medium. The transfer capability of the developing agent is improved by using a first developing agent containing a additive having a small average particle diameter, followed by using a second developing agent containing a second additive having a large average particle diameter larger. Alternatively, a first developing agent containing a first toner having a small roundness is used first, followed by using a second developing agent containing a second toner having a large roundness. Still alternatively, a first developing agent containing a small amount of a first additive is used first, followed by using a second developing agent containing a large amount of a second additive.

7 Claims, 2 Drawing Sheets

IMAGE FORMING APPARATUS USING A DEVELOPING AGENT HAVING COMPONENTS OF VARYING SIZE

BACKGROUND OF THE INVENTION

The present invention relates to an image forming apparatus such as an electrophotographic type color copying machine or a color printer, in which developed developing agent images are superposed one upon the other in succession to form a colored image.

In the general method of forming a full color image, as disclosed in Japanese Patent Unexamined Publication H/6-110343, the formation of a visible image on a photoreceptor drum by the steps of the charging, light-exposure and development with the developing and the transfer of the developed visible image onto a recording medium or an intermediate transfer medium are successively carried out for each color, and these steps of formation and transfer of the visible image for each color are carried out repeatedly depending on the number of colored developing agents used.

When a visible image of a second developing agent is transferred onto a visible image of a first developing agent formed in advance, the transfer capability of the second visible image tends to be markedly impaired by the residual charge of the first developing agent transferred in advance. The impaired transfer capability brings about serious problems. First of all, the second developing agent is unlikely to be transferred onto the first developing agent, resulting in deterioration of the transferred image quality. Particularly, a so-called "hollow" phenomenon and an increase in the waste material caused by an increase in the waste toner are brought about. When it comes to, particularly, an apparatus for performing a color reproduction by superposing a plurality of colored toners one upon the other, it is difficult to reproduce a desired color.

BRIEF SUMMARY OF THE INVENTION

An object of the present invention, which has been achieved in view of the situation described above, is to provide an image forming apparatus satisfactory in its visible image transfer capability so as to obtain a satisfactory picture image while preventing defective images such as occurrence of a hollow phenomenon and reduction in color reproducibility. The present invention also permits decreasing the amount of the waste toner so as to suppress the environmental problems and lower the running cost.

The present invention includes the following aspects.

According to a first aspect of the present invention, there is provided an image forming apparatus, comprising:

first developed image forming means for forming a first developed image on a first image carrier by using a first developing agent containing a binder resin, a coloring agent, and a component having a first average particle diameter;

second developed image forming means for forming a developed image on a second image carrier by using a second developing agent containing a binder resin, a coloring agent, and a component having a second average particle diameter; and transfer means for electrostatically transferring the first developed image onto a recording medium, followed by electrostatically transferring the second developed image onto the recording medium.

According to a second aspect of the present invention, there is provided an image forming method, comprising:

a first developed image forming step for forming a first developed image on a first image carrier using a first developing agent containing a first additive;

a first transfer step for electrostatically transferring the first developed image onto a recording medium;

a second developed image forming step for forming a second developed image on a second image carrier by using a second developing agent containing a second additive differing in such as size, shape, or mixing ratio if the additive consists of at least two component, from the first additive and superior to the first additive in its transfer capability; and a second transfer step for electrostatically transferring the second developed image onto the recording medium having the first developed imaged transferred thereonto in advance.

The image forming apparatus and the image forming method of the present invention permit improving the image transfer capability and preventing image omission, defective color reproducibility, etc., making it possible to obtain a satisfactory picture image. Further, the amount of the waste toner can be decreased so as to alleviate the waste disposal problem.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
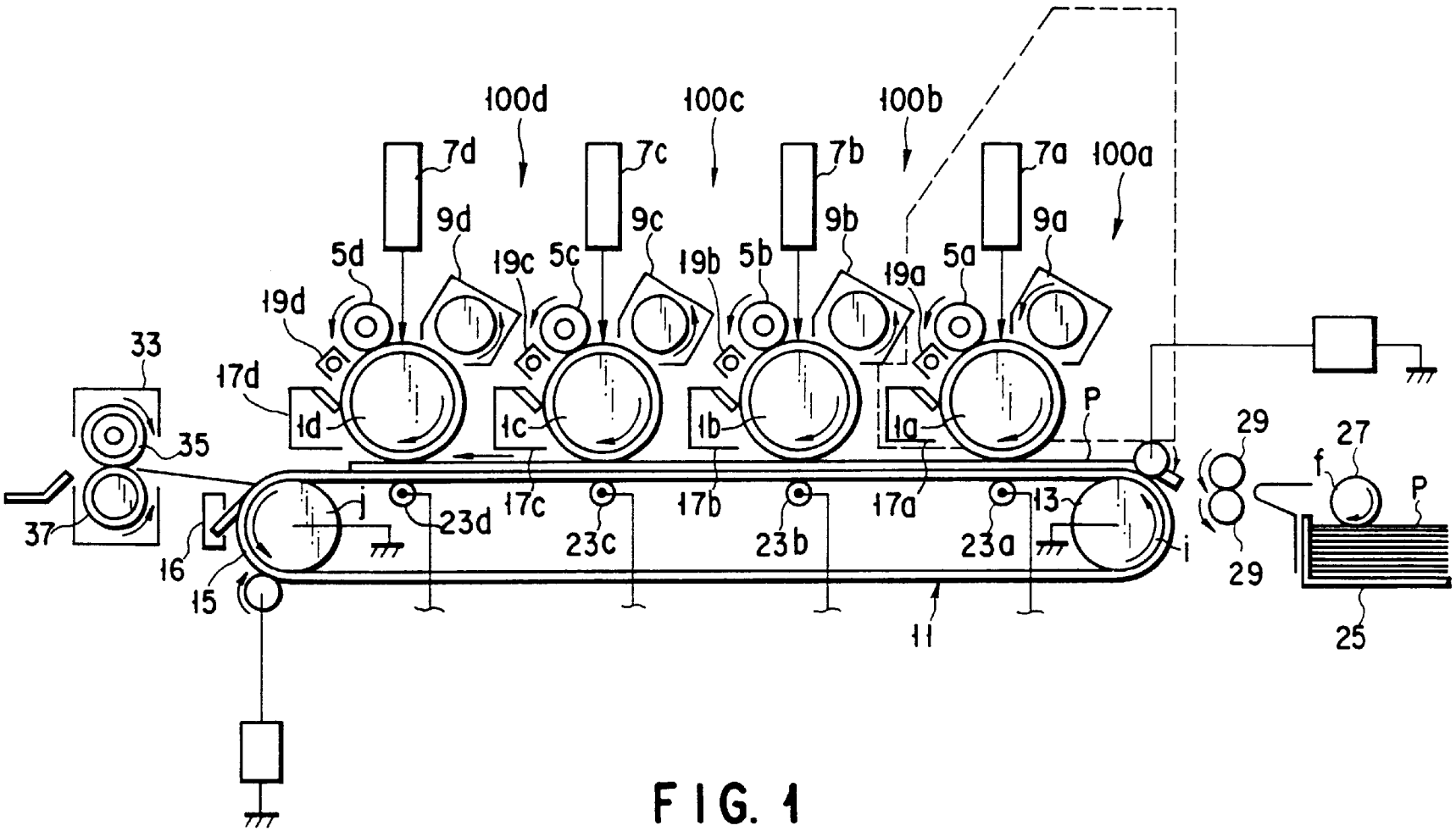
FIG. 1 schematically shows the construction of an image forming apparatus according to a first aspect of the present invention.

The present inventors have found that, in transferring developing agents repeatedly, the residual charge of a first developing agent, which has already been transferred, causes the transfer capability of a second developing agent, which is to be then transferred, to be markedly impaired. As a result of extensive research conducted in an attempt overcome this difficulty, the present inventors arrived at an idea of using an additive so as to make the transfer capability of the second developing agent higher than that of the first developing agent.

An additive is mainly divided into two types of additives. One is a "post-additive," which includes a fluidizing agent, an antistatic agent, or the like and is mixed in a pulverized or polymerized toner particle containing a coloring agent and a binder. The other is a "pre-additive" used in the toner manufacturing step together with a resin and a coloring agent.

In this invention, the post-additive is used as a main additive.

The recording medium used in the present invention includes, for example, a paper sheet or a resin sheet, as well as an intermediate transfer member as required.

For improving the transfer capability of the developing agent, it is effective to use an additive having a large particle diameter. In the case of using an additive having a large particle diameter, the contact area between the toner and the photoreceptor is decreased so as to decrease the mechanical bonding strength between the toner and the photoreceptor. If the particle diameter of the additive is unduly large, however, the fluidity of the toner and the developing agent is impaired.

Under the circumstances, the present inventors have conducted experiments in an attempt to look into the relationship among the particle diameter of the additive, the transfer capability and the toner fluidity. Specifically, a developing agent was prepared by adding 1% by weight of an additive to a polyester toner having an average particle diameter of 8 $\mu$m and prepared by a pulverizing method. Several kinds of developing agents were prepared by adding several kinds of additives differing from each other in the particle diameter. The transfer capability and the toner fluidity of each of these developing agents were measured as follows:

Transfer Capability:

For measuring the transfer capability, a solid image was printed on a paper sheet using a copying machine, followed by collecting the residual toner from the photoreceptor of the copying machine using a "Mending Tape" available from 3M Inc. Then, the reflectance $\Delta Y$ of the Mending Tape was measured so as to determine the transfer capability. The smaller value of $\Delta Y$ denotes the better transfer capability.

Toner Fluidity:

For measuring the toner fluidity, 100 g of the toner was disposed on a mesh of predetermined mesh size. Then, the mesh was kept vibrated for 60 seconds, followed by measuring the toner amount remaining on the mesh. The smaller value of the toner amount represents the better toner fluidity.

Table 1 shows the results.

TABLE 1

(Relationship between silica particle diameter and toner properties)

| | Silica particles | | | | | |
|---|---|---|---|---|---|---|
| | A | B | C | D | E | F |
| Silica particle diameter (nm) | 12 | 16 | 20 | 24 | 50 | 80 |
| Transfer capability ($\Delta Y$) | 16.8 | 14.2 | 11.9 | 8.7 | 7.1 | 6.7 |
| Toner Fluidity (g) | 0.8 | 1.6 | 2.5 | 4.2 | 5.1 | 6.5 |

An additional developing agent was prepared as above, except that titanium oxide particles were used as an additive in place of the silica particles used in the experiment described above. Also, the transfer capability $\Delta Y$ and the toner fluidity were measured as in the experiment described above, with the results as shown in Table 2.

TABLE 2

| | Titanium oxide particles | | | |
|---|---|---|---|---|
| | A | B | C | D |
| Titanium oxide particle diameter (nm) | 20 | 50 | 120 | 200 |
| Transfer capability ($\Delta Y$) | 28.9 | 20.3 | 16.2 | 13.6 |
| Toner fluidity (g) | 1.1 | 3.9 | 11.3 | 15.5 |

Additional experiments were conducted using various other fine particles such as fine particles of metal oxide, such as alumina and fine resin particles, as additives in place of the silica fine particles or the titanium oxide fine particles, with substantially the same results.

As is apparent from Tables 1 and 2, the transfer capability is improved and the toner fluidity is lowered with increases in the particle diameter of the additive. It follows that the toner fluidity can be controlled by changing the additive used.

The transfer characteristics of the developing agent are controlled by changing the average particle diameter of the additive used, as described previously. On the other hand, the present inventors have also arrived at the idea that it will be possible to control the transfer characteristics of the developing agent by changing the roundness of the toner particle.

If the roundness of the toner particle is increased, the contact area between the toner and the photoreceptor is decreased so as to decrease the mechanical bonding strength between the toner and the photoreceptor. As a result, the transfer characteristics of the developing agent are improved.

The roundness of the toner particle can be controlled, for example, during the pulverization and classification steps, after the pulverization and classification steps, or after the mixing step of the additive.

To be more specific, the roundness of the toner particle can be controlled by, for example, a mechanochemical method, in which toner particles are put in a gaseous stream flowing at a high speed so as to subject the toner particles to the functions of friction, lubrication, dissolution and fusion. It is also possible to put the toner particles in a hot gaseous stream so as to subject the toner particles to the functions of fusion and dissolution. These methods can be performed by using, for example, a Hybritizer, Kryptron, or Metanofusion.

Where a toner is prepared by a polymerization method, the roundness of the toner particles can be controlled by, for example, selecting appropriately, the monomers used for the polymerization and the conditions for the polymerization. The polymerization method represents a method, in which a dispersion containing monomers providing the base of a binder resin, a coloring agent and other additives is subjected to polymerization, and the resultant polymer is supplied to the steps of formation, drying, classification, mixing with additives, etc., so as to obtain toner particles.

The present inventors have conducted experiments as follows in an attempt to look into the relationship among the roundness of the toner particle, the transfer characteristics of the developing agent, and the toner fluidity. Specifically, a polyester toner containing carbon particles having an average particle diameter of 8 $\mu$m was prepared first by a pulverization method. The roundness of the particles of the toner thus prepared was controlled to fall within a range of between 0.80 and 0.96 by a Hybritizer, followed by adding 1% of silica particles having an average diameter of 50 nm to the toner.

Likewise, 1% of silica particles having an average particle diameter of 50 nm were added to a toner prepared by a polymerization method to obtain toner particles having an average roundness of 0.99. The transfer characteristics of these toners prepared by the pulverization method and the polymerization method were measured, with the results as shown in Table 3.

For measuring the average roundness of the toner particles, which is a ratio of the shortest diameter to the longest diameter of the toner particle, the developing agent particles were suspended in an aqueous solution.

TABLE 3

(Average roundness and transfer characteristics of toner)

| | Toner A | Toner B | Toner C | Toner D | Toner E |
|---|---|---|---|---|---|
| Roundness | 0.80 | 0.87 | 0.95 | 0.96 | 0.99 |
| Transfer characteristics ΔY | 7.1 | 5.6 | 4.0 | 3.7 | 0.77 |

As is apparent from Table 3, the transfer characteristics are improved with an increase in roundness the toner. It should be noted that an improvement in the transfer characteristics of the developing agent is recognized if the difference in roundness of the toner is 0.01 or more, and the roundness of the toner falls in general within a range between 0.7 and 1.0. It follows that, where 4 kinds of toners are transferred in an overlapping fashion, it is desirable for the difference in roundness among these toners to fall within a range of between 0.01 and 0.1.

Further, when it comes to the toner prepared by the pulverization method, one additional step is required after the pulverizing-classifying step for improving the roundness of the toner. This is not desirable in terms of the manufacturing cost of the toner. Also, if the roundness is controlled in the pulverizing step, the toner yield is impaired in some cases. Under the circumstances, it is desirable to control the roundness of the toner in the vicinity of the lower limit required.

As is apparent from Table 1, silica particles used as an additive, which have a small particle diameter, are effective for imparting a sufficient fluidity to the toner. On the other hand, silica particles having a large particle diameter are effective for imparting a good transfer capability to the toner. However, it is often impossible for the silica particles to impart simultaneously both sufficient fluidity and sufficient transfer capability to the toner regardless of the particle size of the silica particles. This is also the case with the titanium oxide particles shown in Table 2. Under the circumstances, the present inventors have conducted an additional experiment using two kinds of additives in combination, i.e., an additive having a small particle diameter, which is effective for improving the fluidity of the toner, and another additive having a large particle diameter, which is effective for improving the transfer capability of the toner. Specifically, a developer was prepared by adding 0 to 1% by weight of silica particles having a particle diameter of 50 nm, which is shown in Table 1, and 1% by weight of titanium oxide particles having a particle diameter of 20 nm, which is shown in Table 2, to a polyester toner prepared by a pulverizing method, the polyester toner containing carbon black having a particle diameter of 8 μm. The transfer characteristics and the toner fluidity of the resultant developing agent were measured, with the results as shown in Table 4.

TABLE 4

| | Additive A | Additive B | Additive C | Additive D | Additive E | Additive F | Additive G |
|---|---|---|---|---|---|---|---|
| Amount of Titaniuin oxide (20 nm of particle diameter) | 1.0 | 1.0 | 1.0 | 1.0 | 1.0 | 1.0 | 1.0 |
| Amount of Silica (50 nm of particle diameter) | 0.00 | 0.05 | 0.25 | 0.50 | 0.75 | 1.00 | 5.00 |
| Transfer capability (ΔY) | 13.6 | 10.5 | 9.3 | 8.0 | 1.7 | 7.1 | 6.7 |
| Toner Fluidity (g) | 1.1 | 1.1 | 1.2 | 1.4 | 1.8 | 2.2 | 6.5 |

As is apparent from Table 4, the transfer characteristics of the developing agent can be improved by increasing the amount of the additive having a large particle diameter. In this case, however, the toner fluidity is lowered. Table 4 also shows that satisfactory transfer characteristics and toner characteristics can be obtained by adding a large amount of a additive having a small particle diameter, i.e., titanium oxide particles, relative to an additive having a large particle diameter, i.e., silica particles.

The additives used in the present invention include, for example, titanium oxide, silica, and alumina. In addition, the wax and anti-static agents described above can also be used as an additive.

Let us describe Examples of the image forming apparatus of the present invention, which have been achieved in view of the experimental data given previously.

EXAMPLE 1

FIG. 1 schematically shows an image forming apparatus according to one embodiment of the present invention. The apparatus is used for working an image forming method of the present invention.

A first process unit 100*a* is formed of the photoreceptor drum 1*a*, charging roller 5*a*, light-exposure section 7*a*, developer 9*a*, blade cleaning device 17*a* and destaticizing lamp 19*a* described above. Each process unit 100*b*, 100*c*, 100*d*, thereafter has a respective photoreceptor drum 1*b*, 1*c*, 1*d*, charging roller 5*b*, 5*c*, 5*d*, light-exposure section 7*b*, 7*c*, 7*d*, developer 9*b*, 9*c*, 9*d*, blade cleaning device 17*b*, 17*c*, 17*d*, and destaticizing lamp 19*b*, 19*c*, 19*d*.

In addition to the first process unit 100*a*, three additional process units, i.e., a second process unit 100*b*, a third process unit 100*c*, and a fourth process unit 100*d*, are arranged above the transfer belt 11 stretched between the tension roller 13 and the driving roller 15. These process units 100*a*, 100*b*, 100*c* and 100*d* are collectively termed a process unit 100 herein later. Each of these process units 100*b*, 100*c* and 100*d* is substantially equal in construction to the process unit 100*a*. However, these process units 100 differ from each other in the developing agent housed in the developers 9*a*, 9*b*, 9*c*, 9*d*. Specifically, a first developing agent, which is yellow, is housed in the developer 9*a* of the process unit 100*a*. A second developing agent, which is magenta, is housed in the developer 9*b* of the process unit 100*b*. A third developing agent, which is cyan, is housed in the developer 9*c* of the process unit 100*c*. Further, a fourth developing agent, which is black, is housed in the developer 9*d* of the process unit 100*d*.

The first developing agent contains silica particles A shown in Table 1, which have a particle diameter of 12 nm, as a first additive. The second developing agent contains silica particles B shown in Table 1, which have a particle diameter larger than that of the silica particles A, as a second additive. The third developing agent contains silica particles C shown in Table 1, which have a particle diameter larger than that of the silica particles B, as a third additive. Further, the fourth developing agent contains silica particles D shown in Table 1, which have a particle diameter larger than that of the silica particles C, as a fourth additive. As already described in conjunction with the experiment conducted by the present inventors, the developing agent was prepared by adding 1% by weight of the additive to the polyester toner containing carbon black having a particle diameter of 8 $\mu$m. As a result, the transfer characteristics, which are dependent on the particle size of the additive, of the developing agents are adjusted to be improved in the order of the first, second, third and fourth developing agents, the fourth developing agent exhibiting the highest transfer capability.

It is possible to use the first to fourth developing agents of the same or different components, e.g., materials of the binder resin or additive, except for the coloring material as far as the required transfer characteristics can be obtained. However, it is desirable to use the developing agents of the same components except for the coloring material because the transfer characteristics of the developing agents can be controlled easily in the case of using the developing agents of the same components.

In reproducing a color picture image, the paper sheet P transferred by the endless belt 11 is successively brought into contact with the four photoreceptor drums 1*a*, 1*b*, 1*c*, 1*d*. Power supply rollers 23*a*, 23*b*, 23*c* and 23*d* acting as a transfer means, which are hereinafter referred to collectively as a power supply roller 23, are arranged below the photoreceptor drums 1, respectively, such that the endless belt 11 supporting the paper sheet P is held therebetween. As is apparent from the drawing, the power supply rollers 23 are in contact with the back surface of the endless belt 11 supporting the paper sheet P.

In the image forming process performed by the image forming apparatus of the construction described above, each of the four rotating photoreceptor drums 1*a*, 1*b*, 1*c*, 1*d* included in the four process units 100 is uniformly charged at about −500 V by the contact charging roller 5*a*, 5*b*, 5*c*, 5*d* to which is applied an AC-superposed DC bias. The photoreceptor drum 1*a*, 1*b*, 1*c*, 1*d* uniformly charged by the charging roller 5*a*, 5*b*, 5*c*, 5*d* is selectively exposed to light emitted from the light exposure section 7*a*, 7*b*, 7*c*, 7*d* consisting of a fixed scanning head for performing a light exposure using a phosphor so as to form an electrostatic latent image on the surface of the photoreceptor drum 1*a*, 1*b*, 1*c*, 1*d*. The electrostatic latent image is then developed in the developer 9*a*, 9*b*, 9*c*, 9*d* into a predetermined color image by the developing agent, which is sufficiently charged in advance, of a predetermined color.

On the other hand, the paper sheet P is picked up by the pick-up roller 27 from the paper feeding cassette 25 so as to be sent into the paired resist rollers 29. Upon receipt of the paper sheet P, the resist rollers 29, which are rotated to take timing with rotation of the photoreceptor drum 1*a*, permit the paper sheet P to be sent onto the endless belt 11.

When the paper sheet P is transferred to a transfer position of the first process unit 100*a*, a bias voltage is applied from the power supply roller 23*a* to the endless belt 11, with the result that a transfer electric field is formed between the photoreceptor drum 1*a* and the endless belt 11. It follows that the first developing agent on the surface of the photoreceptor drum 1*a* is transferred onto the paper sheet P. Then, the paper sheet P bearing the first developed image is transferred to reach the photoreceptor drum 1*b* of the second process unit 100*b*. Then, the second developed image formed on the surface of the photoreceptor drum 1*b* is transferred onto the paper sheet P bearing the first developed image such that the second developed image is superposed on the first developed image. The paper sheet P bearing the first and second developed images is further transferred to reach the photoreceptor drum 1*c* and, then, the photoreceptor drum 1*d*, with the result that the third and fourth developed images are transferred onto the paper sheet P such that the first to fourth developed images are superposed one upon the other on the paper sheet P so as to reproduce the original color image on the paper sheet P.

The paper sheet P bearing the first to fourth developed images in a superposed fashion is transferred from the endless belt 11 onto a fixing device 33 which comprises a heating roller 35 and a pressing roller 37 which is also heated. The paper sheet P bearing the developed images is passed between the heating roller 33 and the pressing roller 37 such that the developed images on the paper sheet P are in contact with the heating roller. As a result, the developed images are fixed to the paper sheet P.

After the paper sheet P is moved away from the endless belt 11, the surface of the endless belt is subjected to cleaning by a blade cleaning device 16.

The image forming apparatus of the particular construction has been found to be capable of transferring a developed image of any color onto the paper sheet P so as to form a colored image of an excellent color reproducibility.

EXAMPLE 2

An image formation was performed as in Example 1, except that silica particles A, B, C and D shown in Table 1 were used as additives for preparing first, second, third and fourth developing agents, respectively. The resultant color images were found to be satisfactory as in Example 1.

EXAMPLE 3

An image formation was performed as in Example 1, except that titanium oxide particles A, B, C and D shown in Table 2 were used as additives for preparing first, second, third and fourth developing agents, respectively. The resultant color images were found to be satisfactory as in Example 1.

EXAMPLE 4

An image formation was performed as in Example 1, except that additives A, B, C and D shown in Table 4, which consisted of silica particles and titanium oxide particles, were used as additives for preparing first, second, third and fourth developing agents, respectively. The resultant color images were found to be more satisfactory than in Examples 1 to 3.

EXAMPLE 5

The image forming apparatus used in Example 5 is a modification of the image forming apparatus used in Example 1, though the developing agents used in Example 5 were equal to those used in Example 1.

Figure 2:
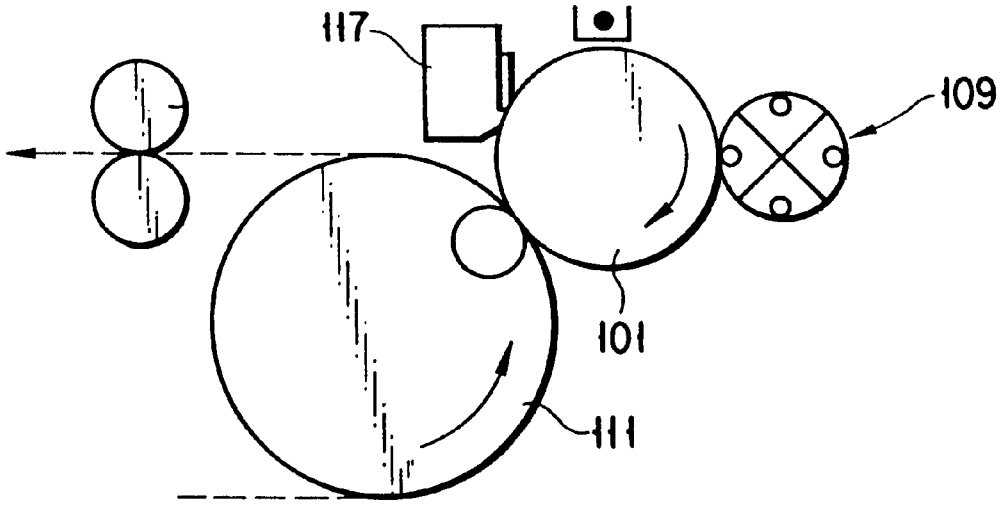
FIG. 2 schematically shows a portion of an image forming apparatus according to a second aspect of the present invention.

FIG. 2 shows the image forming apparatus used in Example 5. As shown in the drawing, the apparatus comprises a photoreceptor drum 101 acting as an image carrier. A developer 109 housing a developing agent is arranged in contact with the drum 101. A transfer means 111, which is in the form of, for example, a roller, is arranged downstream of the developer 109 in the rotating direction of the photoreceptor drum 101.

The image forming apparatus used in Example 5 is a modification of the apparatus used in Example 1. On the other hand, the developing agents used in Example 5 were equal to those used in Example 1.

EXAMPLE 6

Figure 3:
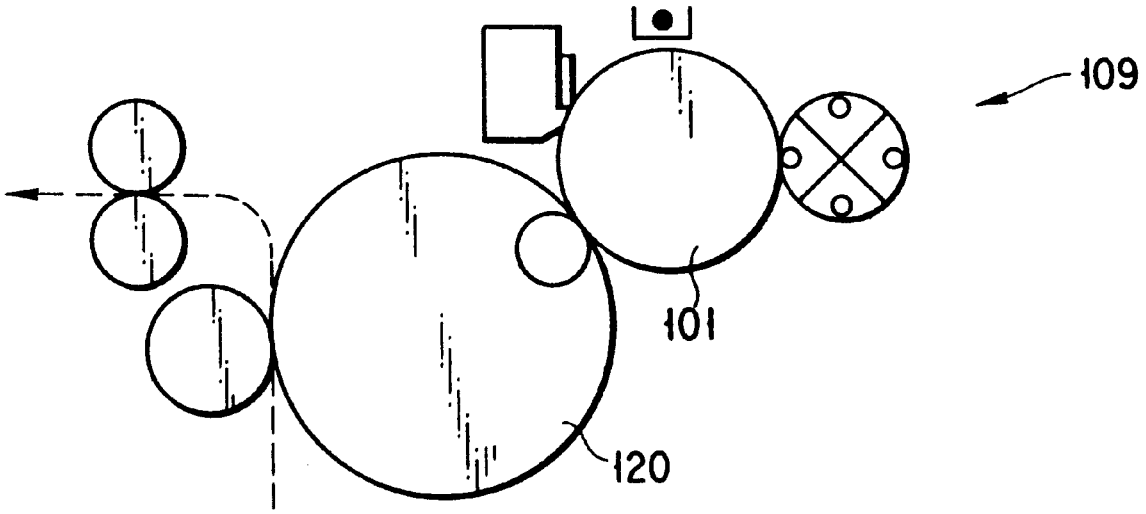
FIG. 3 schematically shows a portion of an image forming apparatus according to a third aspect of the present invention.

FIG. 3 schematically exemplifies the construction of the image forming apparatus used in Example 6. In the image forming apparatus shown in FIG. 3, after a developed image is temporarily formed on an intermediate transfer member 120, the developed image is transferred to a recording paper from the transfer member 120.

The developing agent equal to that used in Example 1 can be used in the image forming apparatus shown in FIG. 3. To reiterate, the additive contained in the first developing agent has a particle diameter smaller than that of the additive contained in the second developing agent. Also, the additive contained in the second developing agent has a particle diameter smaller than that of the additive contained in the third developing agent. Further, the additive contained in the third developing agent has a particle diameter smaller than that of the additive contained in the fourth developing agent. As a result, the transfer characteristics are improved in the order of the first, second, third and fourth developing agent which exhibits the best transfer characteristics. It should be noted in respect of the image forming apparatus of Example 6 that, in that region of the intermediate transfer member 120 in which the first, second, third and fourth developed images are all superposed one upon the other, these developed images area transferred onto the paper sheet in the order of the fourth, third, second and first developed images. If the transfer characteristics of the first developing agent, which is positioned most remote from the surface of the paper sheet, is unduly lower than the transfer characteristics of the fourth developing agent, it is possible for the first developing agent not to be transferred onto the paper sheet so as to remain on the intermediate transfer member 120. To overcome this difficulty, the same additive is used for preparing the first and fourth developing agents so as to make these first and fourth developing agents substantially equal to each other in the transfer characteristics.

To be more specific, silica particles A, B, C and A shown in Table 1 are used as additives for the preparation of the first, second, third and fourth developing agents, respectively, so as to obtain satisfactory results.

EXAMPLE 7

Image formation was performed substantially as in Example 6, except that silica particles A, C, C and A shown in Table 1 were used as additives in preparation of a first developing agent, a second developing agent, a third developing agent and a fourth developing agent, respectively, obtaining satisfactory result.

It should be noted that, if the toner used in the first developing agent and the toner used in the second developing agent are designed to exhibit substantially the same charging characteristics, the apparatus body can be controlled easily by simply changing the additive mixed in the developing agent. The additives exhibit charging characteristics inherent in the individual materials. For example, silica tends to be strongly charged negative. Also, titanium oxide tends to be charged slightly positive. Therefore, it is desirable to impart substantially the same charging characteristics by using the additive of the same composition in each of the toners used in the first developing agent and the second developing agent. In this case, the transfer characteristics can be improved substantially proportionally by making the average particle diameter of the additive of the second developing agent larger than that of the additive of the first developing agent. In order to increase the average particle diameter, it is desirable to prepare at least two kinds of materials having the same composition and differing from each other in the average particle diameter. Naturally, the average particle diameter can be increased by increasing the mixing ratio of the material having the large average particle diameter. It should be noted, however, that, in order to ensure a sufficient fluidity, the particle diameter of the additive should desirably be as small as possible within a range of imparting a sufficient transfer capability to the developing agent.

It should also be noted that the transfer capability of the developing agent can be improved if a additive having a large particle diameter is added in an amount of 0.05% by weight to a additive having a small particle diameter. On the other hand, the value of the transfer capability reaches a saturation if a ratio of the additive having a large particle diameter is increased to reach 5% by weight. It follows that the amount of the additive having a large particle diameter should desirably fall within a range of between 0.05% and 5% based on the amount of the additive having a small particle diameter.

Further, if the difference in the particle diameter is 2 nm or more, it is possible to improve the transfer capability. On the other hand, if the difference in the particle diameter is unduly large, the additive fails to impart a sufficient fluidity to the developing agent. It follows that the difference in the particle diameter between the additives having small and large particle diameters should desirably fall within a range of between 2 nm and 50 nm.

In addition to the combination of the two kinds of the additives employed in Example 7, it is possible to employ various other combinations.

EXAMPLE 8

The image forming apparatus used in this example is substantially equal in construction to the image forming apparatus shown in FIG. 1, except that the first to fourth developing agents differing from those used in Example 1 were housed in the developers 9*a,* 9*b,* 9*c* and 9*d.*

Specifically, the first developing agent contained a toner A shown in Table 3, the toner A having been controlled by a hybritizer to have a first roundness. The second developing agent contained a toner B having a second roundness larger than the first roundness. Further, the third developer contained a toner C having a third roundness larger than the second roundness. Still further, the fourth developing agent D contained a toner D having a fourth roundness larger than the third roundness. As apparent from Table 3, these first, second, third and fourth developing agents were controlled to exhibit a transfer capability in the order mentioned. To be more specific, the fourth transfer agent containing the fourth toner D exhibits the highest transfer capability.

The first to fourth toners may be the same or different in the components except the coloring material. For example, it is possible for these toners to contain the same or different binder resins or additives. However, it is desirable for these toners to contain the same components other than the coloring material because the transfer characteristics can be controlled easily in this case.

Since the transfer characteristics of the developing agents used in Example 8 are substantially equal to those of the developing agent used in the image forming apparatus shown in FIG. 1, the image forming apparatus used in Example 8 is operated in substantially the same manner as in the apparatus shown in FIG. 1.

Needless to say, the developing agents used in Example 8 may be used in the image forming apparatus shown in each of FIGS. 2 and 3.

Where the developing agents used in Example 8 are used in the image forming apparatus shown in FIG. 3, it is desirable to control the roundness of the first toner to be substantially equal to that of the fourth toner, as in Example 6, so as to permit these first and fourth toners to exhibit substantially the same transfer characteristics.

EXAMPLE 9

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. An image forming apparatus, comprising:

first developed image forming means for forming a first developed image on a first image carrier by using a first developing agent containing a binder resin, a coloring agent and a component having a first average particle diameter;

second developed image forming means for forming a second developed image on a second image carrier by using a second developing agent containing a binder resin, a coloring agent, and a component having a second average particle diameter greater than the first average particle diameter; and transfer means for electrostatically transferring said first developed image onto a recording medium, followed by electrostatically transferring said second developed image onto said recording medium.

2. An image forming apparatus comprising:

first developed image forming means for forming a first developed image on a first image carrier by using a first developing agent containing a binder resin, a coloring agent and a component having a first average particle diameter;

second developed image forming means for forming a second developed image on a second image carrier by using a second developing agent containing a binder resin, a coloring agent, and a component having a second average particle diameter greater than the first average particle diameter;

third developed image forming means for forming a third developed image on an image carrier by using a third developing agent containing a binder resin, a coloring agent, and a component having a third average particle diameter substantially equal to the first average particle diameter;

an intermediate transfer member onto which said first developed image, said second developed image, and said third developed image are successively transferred electrostatically; and a transfer means for electrostatically transferring said first developed image onto a recording medium, followed by electrostatically transferring said second developed image onto said recording medium, and for transferring electrostatically the third developed image from said intermediate transfer means onto the recording medium after transfer of the first and second developed images.

3. An image forming apparatus, comprising:

first developed image forming means for forming a first developed image on a first image carrier by using a first developing agent containing a binder resin, a coloring agent and a component having a first average roundness;

second developed image forming means for forming a second developed image on a second image carrier by using a second developing agent containing a binder resin, a coloring agent, and a component having a second average roundness greater than said first average roundness; and transfer means for electrostatically transferring said first developed image onto a recording medium, followed by electrostatically transferring said second developed image onto said recording medium.

4. An image forming apparatus according to claim 3, further comprising:

third developed image forming means for forming a third developed image on an image carrier by using a third developing agent containing a binder resin, a coloring agent, and a component having a third average roundness substantially equal to the first average roundness;

an intermediate transfer member onto which said first developed image, said second developed image, and said third developed image are successively transferred electrostatically; and transfer means for electrostatically transferring said first developed image onto a recording medium, followed by electrostatically transferring said second developed image onto said recording medium, and for transferring electrostatically the third developed image from said intermediate transfer means onto the recording medium after transfer of the first and second developed images.

5. An image forming apparatus, comprising:

first developed image forming means for forming a first developed image on a first image carrier by using a first developing agent containing a binder resin, a coloring agent, a component having a first average particle diameter, and a component having a second average particle diameter greater than the first average particle diameter and mixed with the component having the first average particle diameter at a first mixing ratio;

second developed image forming means for forming a second developed image on a second image carrier by using a second developing agent containing a binder resin, a coloring agent, and said two components contained in said first developing agent, the component having the second average particle diameter being mixed with the component having the first average diameter at a second mixing ratio greater than the first mixing ratio; and transfer means for electrostatically transferring said first developed image onto a recording medium, followed by electrostatically transferring said second developed image onto said recording medium.

6. An image forming apparatus, comprising:

first developed image forming means for forming a first developed image on an image carrier by using a first developing agent containing a component having a first average particle diameter;

second developed image forming means for forming a second developed image on said image carrier by using a second developing agent containing a component having a second average particle diameter greater than the first average particle diameter; and transfer means for electrostatically transferring said first developed image onto a recording medium and for electrostatically transferring said second developed image onto said recording medium.

7. An image forming apparatus, comprising:

first developed image forming means for forming a first developed image on an image carrier by using a first developing agent containing a component having a first average roundness;

second developed image forming means for forming a second developed image on said image carrier by using a second developing agent containing a component having a second average roundness greater than the first average roundness; and transfer means for electrostatically transferring said first developed image onto a recording medium and for electrostatically transferring said second developed image onto said recording medium.

* * * * *